US009435097B2

(12) United States Patent
Locotos

(10) Patent No.: US 9,435,097 B2
(45) Date of Patent: Sep. 6, 2016

(54) METHOD FOR JOINING PLASTIC PARTS AND FOUNDATION MAT PRODUCT THEREFOR

(71) Applicant: F.M. Locotos Co., Inc., Pittsburgh, PA (US)

(72) Inventor: Frank M. Locotos, Bridgeville, PA (US)

(73) Assignee: F.M. Locotos Co., Inc., Pittsburgh, PA (US)

( * ) Notice: Subject to any disclaimer, the term of this patent is extended or adjusted under 35 U.S.C. 154(b) by 0 days.

(21) Appl. No.: 14/973,820

(22) Filed: Dec. 18, 2015

(65) Prior Publication Data

US 2016/0177531 A1 Jun. 23, 2016

Related U.S. Application Data

(60) Provisional application No. 62/095,219, filed on Dec. 22, 2014.

(51) Int. Cl.
*E02D 27/44* (2006.01)
*E02D 27/08* (2006.01)
*E02D 27/01* (2006.01)

(52) U.S. Cl.
CPC ..... *E02D 27/44* (2013.01); *E02D 27/016* (2013.01); *E02D 27/08* (2013.01)

(58) Field of Classification Search
CPC ..... E02D 27/44; E02D 27/08; E02D 27/016
See application file for complete search history.

(56) References Cited

U.S. PATENT DOCUMENTS 3,015,912 A * 1/1962 Fistedis ..... E02D 27/44 248/679
4,804,570 A * 2/1989 Bedics ..... A47L 23/24 15/217
5,118,542 A * 6/1992 McLeod ..... E01C 9/08 404/35
5,282,692 A * 2/1994 McLeod ..... E01C 9/086 404/35
5,482,754 A * 1/1996 Crook ..... E01C 9/086 102/303
5,565,257 A * 10/1996 Tingley ..... B27N 3/06 156/178
6,105,471 A * 8/2000 Takayuki ..... B23P 19/068 254/29 A
6,214,428 B1 * 4/2001 Henderson ..... B27M 3/0046 238/14
6,575,660 B1 * 6/2003 Davis ..... E01C 9/086 238/14
6,592,962 B2 * 7/2003 Edwards ..... B27D 1/00 428/105
7,137,226 B2 * 11/2006 Fiutak ..... B27M 3/0053 52/177
7,818,929 B2 * 10/2010 Fiutak ..... B27M 3/0053 52/177
7,819,607 B2 10/2010 Carreras-Maldonado et al.
7,934,885 B2 5/2011 Fournier
8,382,393 B1 2/2013 Phillips
8,545,127 B2 10/2013 Bleile et al.
8,784,001 B1 7/2014 Phillips et al.
8,784,002 B2 * 7/2014 Ringus ..... E01C 9/02 14/2.5

(Continued)

*Primary Examiner* — Mark Wendell
*Assistant Examiner* — Keith Minter
(74) *Attorney, Agent, or Firm* — McKay & Associates, P.C.

(57) ABSTRACT

An assembly method and resulting temporary foundation mat for equipment such as a crane, including the steps of driving a fastener through plastic either with a hydraulic force or pneumatic (air), mechanical, or by any other power assisted means, shown through experimentation to result in the plastic surrounding the bolt within itself, tightly giving added strength to the system. The fastener can have a head at the driven end and a threaded end at the lead end. When a threaded end exists exterior to the joined pieces of plank, the plastic around the threaded end can be power-wire brushed to expose the threads to a nut which then tightens the system. The penetration rate of the fastener into and through the plastic pieces can be increased by pre-heating the lead end of the fastener.

4 Claims, 2 Drawing Sheets

(56) References Cited

U.S. PATENT DOCUMENTS

| | | | | |
|---|---|---|---|---|
| 8,906,480 | B2 * | 12/2014 | Fiutak | E01C 9/086 428/54 |
| 8,936,073 | B1 | 1/2015 | Phillips | |
| 2002/0188074 | A1 * | 12/2002 | Parker | E01C 9/086 525/166 |
| 2003/0113162 | A1 * | 6/2003 | Seaux | E01C 9/086 404/35 |
| 2003/0133751 | A1 * | 7/2003 | Smith | E01C 9/08 404/35 |
| 2007/0056228 | A1 * | 3/2007 | Penland | E01O 5/14 52/177 |
| 2008/0104779 | A1 * | 5/2008 | Schouten | A46B 3/16 15/21.1 |
| 2012/0063844 | A1 | 3/2012 | Wold | |
| 2013/0084133 | A1 | 4/2013 | Ade et al. | |
| 2013/0259568 | A1 | 10/2013 | Bouchard | |
| 2013/0284994 | A1 | 10/2013 | Lagiewka et al. | |
| 2014/0193196 | A1 | 7/2014 | Fournier | |
| 2014/0205377 | A1 | 7/2014 | Hill | |
| 2014/0328623 | A1 | 11/2014 | Ringus et al. | |
| 2014/0341649 | A1 | 11/2014 | Bryan et al. | |

* cited by examiner

METHOD FOR JOINING PLASTIC PARTS AND FOUNDATION MAT PRODUCT THEREFOR

CROSS-REFERENCE TO RELATED APPLICATIONS

Benefit is hereby claimed to U.S. provisional application Ser. No. 62/095,219, filed Dec. 22, 2014, the contents of which are incorporated herein by reference.

BACKGROUND

1. Field of the Invention

The instant invention relates to a system and method for joining two or more pieces of plastic without having to first drill a hole through each, enabling a fastener to push through and be tightened, thereby efficiently forming a product onsite such as a temporary equipment foundation.

2. Description of the Related Art

Temporary equipment foundations such as crane mats can be made of various materials, including wood and plastic, which traditionally are formed by joining planks using fasteners, or they can be pre-formed modules. The planks are fastened in side-by-side relation to form a block or mat. Traditionally, a hole is drilled in the plank through which the fastener is placed. Drilling the hole is very time-consuming and leaves a gap between the fastener (bolt) and the wall of the hole which can possibly lead to a loose system.

The prior art teaches a wide variety of ground cover mats and rig mats. Most of these temporary foundation systems use some form of mechanism for edge-to-edge fastening, such as by tongue-and-groove or interlock. See for example U.S. Pat. No. 8,545,127 to Bleile et al. and U.S. Pat. No. 8,936,073 to Phillips. This is understandable being the mats are temporary. Such "snapping" systems are not suitable for supporting heavy equipment. The more the ease as which such mats are assembled is enhanced, the less strong and durable the mats often become.

The prior art including U.S. Patent Publication No. 2014/0341649 to Bryan et al. teaches using a nut at a lead end for a variety of fasteners, thus a bolt can be driven through plastic and the system tightened, albeit through pre-drilled holes. Bolt-fastened temporary foundations are much more durable and can support considerably more weight because the planks themselves are large and solid. Here, however, because the planks must be drilled to accommodate the fasteners, the assembly process can be time-consuming, which is not desirable for temporary systems.

There is a need then for a crane mat system and assembly method which provides the benefits and strength of being securely bolt-driven, but through un-drilled plastic planks, as follows.

SUMMARY

The invention comprehends an assembly method and resulting product including the steps of driving a fastener (bolt) through plastic either with a hydraulic force or pneumatic (air), mechanical, or by any other power assisted means, shown through experimentation to result in the plastic surrounding the bolt within itself, tightly giving added strength to the system. The fastener can have a head (at the driven end) and a threaded end at the lead end. When a threaded end exists exterior to the joined pieces of plank, the plastic around the threaded end can be power-wire brushed to expose the threads to a nut which then tightens the system. The penetration rate of the fastener into and through the plastic pieces can be increased by pre-heating the lead end of the fastener.

Accordingly, the invention comprehends a foundation mat for equipment such as a crane, including multiple, solid blocks in stacked relation. A fastener is power-driven, e.g. hydraulically, through the blocks. The fastener has a lead end and a head end, wherein the lead end is heated up to 400° F. The means for tensioning the system can include fasteners such as nuts and bolts, smooth or threaded. The threaded ends of the bolts can be exposed by wire-brushing.

In a method for assembling a foundation mat, multiple, plastic, un-drilled blocks are stacked in side-by-side relation. A fastener is power-driven through the system, and the blocks are tensioned. As above, the lead end of the fastener can be heated, and the threaded end of any fastener can include a nut. A first of the multiple blocks can be disposed against a solid object prior to the step of driving the fastener to eliminate crater push-out.

DETAILED DESCRIPTION OF THE PREFERRED EMBODIMENT

Figure 1:
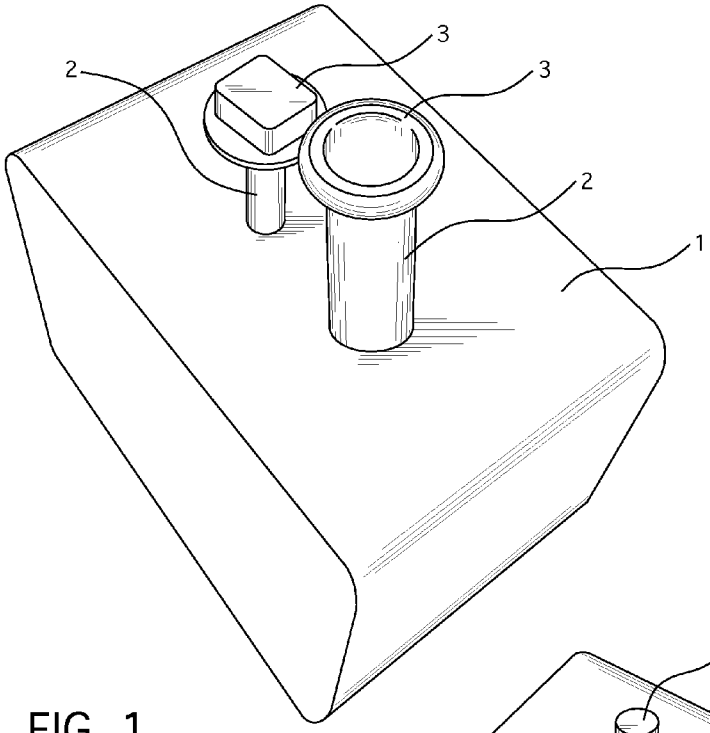
FIG. 1 shows a perspective view of two example rods driven through the plastic block with their head ends exposed.
Figure 2:
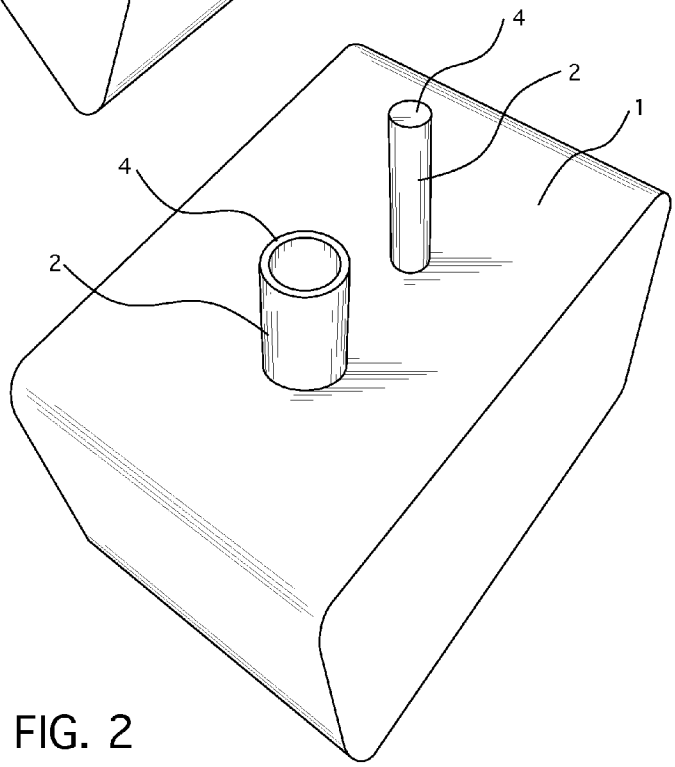
FIG. 2 shows a perspective view of the lead, exposed ends of the rods through the same plastic block.
Figure 3:
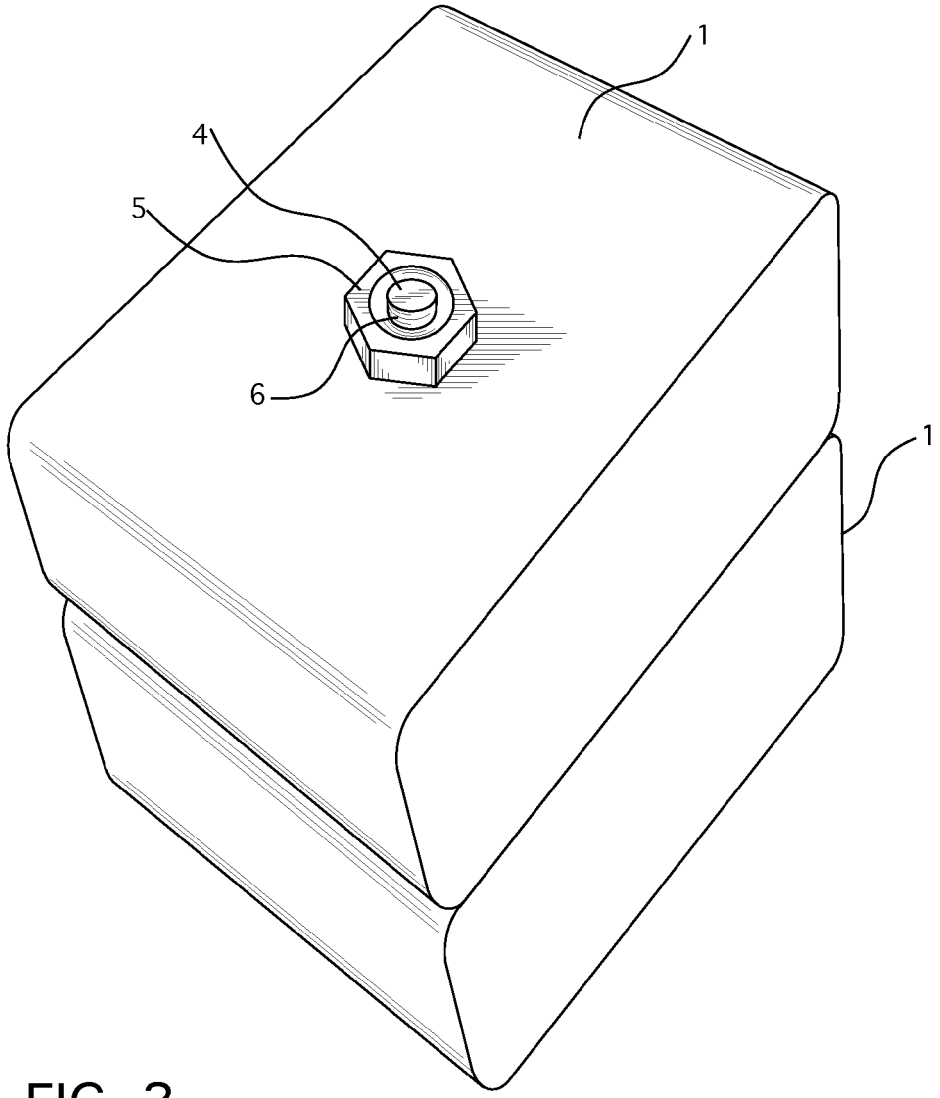
FIG. 3 shows a perspective view of an embodiment wherein the lead end, being threaded, has a nut engaged thereto, and the fastener has secured a pair of blocks.

Referencing then FIGS. 1-3, blocks 1 were formed using recycled plastic. The plastic blocks 1 are "solid", meaning herein they exclude any pre-drilled holes. As an example only and by no means meant to be limiting, the blocks 1 had dimensions of 7"×9"×20", the size and physical characteristics of which simulate part of a crane mat for example, i.e. foundation mat for equipment. The blocks/planks 1 can be stacked (FIG. 3) and/or be individually sized to make up various structures for any type of use other than crane mats or equipment foundations. "Stacked relation" as used herein and as claimed means preferably side-by-side disposition as would comprise a ground-disposed mat, although various formations and shapes can be deployed such as the blocks 1 being vertically stacked.

A fastener 2 is power-driven through the stacked blocks 1. The fastener 2 can be a smooth, solid rod, rebar, or be a hollow rod, each having a lead end 4 first penetrating the block 1 and a head end 3 remaining exposed on the entering side of the block 1. The fastener 2 can also be a bolt having a threaded end. Variations of fasteners can be used depending on the tensioning requirements, thus "means for tensioning". In one example, a headed steel bolt is used as the fastener 2. For example the fastener 2 can be a ¾"×14" headed steel bolt with threads (National Coarse Threading) at its opposite end.

"Power-driven" means the fasteners 2 are forcefully inserted through the undrilled blocks 1 using a mechanical press such as a pneumatic or hydraulic press. In the preferred embodiment, a hydraulic press is utilized to drive the fastener 2. For example, a mounted, 20-ton hydraulic cylinder was used and successful at less than maximum capacity and hand-controlled. A power-assisted pump can also be employed to actuate the hydraulic cylinder.

With particular reference to FIGS. 1-3, shown are two rods 2 driven through the plastic block 1 with their head ends 3 exposed. One rod 2 shows a smooth bar protruding out of the plastic. This is the lead end 4 of the bolt that was being pushed into the piece. The other bolt is a hollow rod and is shown exiting the plastic by way of FIG. 2. It was shoved or forced through from the opposite end as well. A crater may result after the fastener is pushed out on the exiting side, i.e. "crater push-out". To avoid this situation, the bolt-exiting side can be disposed against something solid, for example a solid steel base. Note there are no cracks in the plastic block 1 around the fastener 2.

The exposed, lead ends 4 can be wire brushed to better expose the threads 6 after having penetrated through the plastic block 1 and in-taking plastic shards, now removed, if threaded bolts are used and penetration through the plastic block 1 has occurred. In this manner a threaded nut 5 can be employed to tension the system. See FIG. 3. A nut 5 is shown herein attached to the lead end 4 end of the bolt that exited more than one plastic.

A fastener 2 can be pre-heated on the lead end 4 of up to 400° F. before being pressed in to ease the penetration. This also resulted in making it easier to wire brush the exiting lead end 4 since, as it heated, the plastic around the threads 6 are made temporarily softer. Thus, the step of heating the fastener 2, preferably to up to around 400° F., is an option.

In use then, a fastener 2, optionally with its lead end 4 heated, is hydraulically pressed through one or more plastic blocks 1 or planks, which, when placed in side-by-side relation, are therefore fastened to each other to form a mat having a length and width equal the number and dimensions of the planks. The lead end 4 of the fastener 2 is optionally wire brushed to expose the threads 6. A nut 5 is fastened to the end 4, thereby tensioning the system to further secure the planks 1. The secured planks 1 and thus the formed mat can then be temporarily used as a foundation for equipment such as a crane.

I claim:

1. A method for assembling a ground-disposed foundation mat for equipment, comprising the steps of:

stacking multiple, solid blocks in side-by-side relation, wherein said solid blocks are undrilled plastic and thereby exclude pre-drilled holes;

disposing a first of said multiple solid blocks against a solid steel base to eliminate crater push-out;

heating a lead end of a hollow rod up to 400° F.; and, using a mechanical press, power-driving said hollow rod through said blocks.

2. The method of claim 1, further comprising the step of wire brushing said lead end.

3. The method of claim 1, further comprising the step of fastening a nut to said lead end.

4. The foundation mat of claim 1, wherein each of said blocks has a thickness in the range of 7 inches to 9 inches.

* * * * *